US012031200B2

(12) United States Patent
Ohashi et al.

(10) Patent No.: US 12,031,200 B2
(45) Date of Patent: Jul. 9, 2024

(54) FIN MATERIAL MADE OF ALUMINUM ALLOY FOR HEAT EXCHANGER

(71) Applicant: UACJ Corporation, Tokyo (JP)

(72) Inventors: Yusuke Ohashi, Tokyo (JP); Atsushi Fukumoto, Tokyo (JP); Shogo Yamada, Kariya (JP); Shinichiro Takise, Kariya (JP); Takahiro Shinoda, Kariya (JP)

(73) Assignee: UACJ CORPORATION, Tokyo (JP)

( * ) Notice: Subject to any disclaimer, the term of this patent is extended or adjusted under 35 U.S.C. 154(b) by 199 days.

(21) Appl. No.: 17/108,286

(22) Filed: Dec. 1, 2020

(65) Prior Publication Data

US 2021/0087657 A1 Mar. 25, 2021

Related U.S. Application Data

(62) Division of application No. 15/907,572, filed on Feb. 28, 2018, now abandoned.

(30) Foreign Application Priority Data

Mar. 1, 2017 (JP) ..... 2017-038219

(51) Int. Cl.
*C22C 21/10* (2006.01)
*F28F 21/08* (2006.01)

(52) U.S. Cl.
CPC ..... *C22C 21/10* (2013.01); *F28F 21/084* (2013.01); *F28F 2275/04* (2013.01)

(58) Field of Classification Search
CPC ..... C22C 21/00; C22C 21/02; C22C 21/04; C22C 21/06; C22C 21/08; C22C 21/10; C22C 21/12; C22C 21/14; C22C 21/16; C22C 21/18; C22F 1/04; C22F 1/043; C22F 1/047; C22F 1/05; C22F 1/053; C22F 1/057; F28F 21/084
See application file for complete search history.

(56) References Cited

U.S. PATENT DOCUMENTS 6,610,247 B2 8/2003 Wittebrood et al.
2004/0028940 A1* 2/2004 Toyama ..... F28F 21/084 428/654
2007/0113936 A1 5/2007 Oki et al.
2008/0118393 A1* 5/2008 Oskarsson ..... C22F 1/04 148/696
2015/0144229 A1* 5/2015 Ando ..... B23K 1/0012 148/523
2017/0349980 A1 12/2017 Yoshino et al.
2018/0252485 A1 9/2018 Ohashi et al.
2020/0239989 A1 7/2020 Ando et al.

FOREIGN PATENT DOCUMENTS

EP 1717327 A1 11/2006
JP 2-115336 A 4/1990
JP 2013-216935 A 10/2013

OTHER PUBLICATIONS

Jacobs, M H. "Precipitation Hardening", 1999. European Aluminum Association, pp. 1-47. (Year: 1999).*
Office Action dated Sep. 26, 2018, issued in counterpart DE Application No. 102018001584.0, with English translation (10 pages).
Office Action dated Sep. 4, 2019, issued in counterpart CN application No. 201810162081.3, with English translation (8 pages).
Hutchinson et al, "Mechanisms of Sagging during Brazing of Aluminium Heat Exchangers", Proceedings of the 12th International Conference on Aluminium Alloys, pp. 1579-1584 (Year: 2010).
Jacobs, M H., "Precipitation Hardening", European Aluminum Association, p. 6 (Year: 1999).

* cited by examiner

*Primary Examiner* — Brian D Walck
*Assistant Examiner* — Nazmun Nahar Shams
(74) *Attorney, Agent, or Firm* — WHDA, LLP

(57) ABSTRACT

A method of manufacturing a fin material made of an aluminum alloy for heat exchangers with no fin buckling deformation and having excellent buckling resistance in a temperature range of 400° C. to 580° C. before a filler alloy melts at the time of brazing is provided. The fin material made of an aluminum alloy for heat exchangers contains 1.0 to 2.0 mass % of Mn, 0.7 to 1.4 mass % of Si, and 0.05 to 0.3 mass % of Fe, with the balance being Al and unavoidable impurities, in which a number density of intermetallic compounds having a circle-equivalent diameter of 0.025 to 0.4 μm is $3.0\times10^6$ particles/mm$^2$ or more, and an amount of solid solution of Mn is 0.3 mass % or less.

4 Claims, No Drawings

FIN MATERIAL MADE OF ALUMINUM ALLOY FOR HEAT EXCHANGER

CROSS-REFERENCE TO RELATED APPLICATIONS

This application is a Division of U.S. patent application Ser. No. 15/907,572, filed Feb. 28, 2018, and claims the benefit of Japanese Patent Application No. 2017-038219, filed Mar. 1, 2017, each of which is incorporated by reference herein in its entirety.

TECHNICAL FIELD

The present invention relates to a fin material made of an aluminum alloy for heat exchangers preferably used as a fin material for heat exchangers such as radiators, heater cores, condensers, and intercoolers.

BACKGROUND ART

An aluminum alloy is lightweight and excellent in strength, and further, excellent in thermal conductivity, and thus has been preferably used in materials for heat exchangers such as condensers, radiators, heater cores, and intercoolers.

Such heat exchangers are conventionally assembled by braze-joining a fin of an aluminum formed in a corrugated form by corrugation forming with other members. As a fin material made of an aluminum alloy, pure aluminum based alloys excellent in thermal conductivity, such as JIS 1050 alloys, and Al—Mn based alloys excellent in strength and buckling resistance, such as JIS 3003 alloys have been generally used. In addition, a technique of preventing corrosion of a tube of a heat exchanger by electrochemically lowering the potential of a fin material in order to preferentially corrode the fin material by a sacrificial anode effect has been generally used.

In recent years, there is an increasing demand for size reduction, weight reduction, and performance enhancement of heat exchangers. Along with this demand, reducing thickness of a fin material made of an aluminum alloy has also been required. In order to realize such reduction of thickness, further strength is required to prevent deformation and buckling of a fin material during a manufacturing process of a heat exchanger.

Patent Literature 1, for example, describes a method for manufacturing a material that enhances coarsening of recrystallized grains after braze-heating to improve buckling resistance at high temperature.

PATENT LITERATURE

[Patent Literature 1] Japanese Patent Publication No. H02-115336-A

SUMMARY OF THE INVENTION

Technical Problem

If a fin material is buckled and deformed before reaching a temperature of about 550 to 580° C., which is a temperature at which a filler alloy starts to melt, it may lead to non joining of the fin and other members. Therefore, in a high temperature region at the time of braze-heating, heat resistance (buckling resistance) that would not cause buckling and deformation in the fin is required.

Although Cited Literature 1 enhances coarsening of recrystallized grains after braze-heating, only a small effect is exerted with respect to deformation suppression of the fin material before a temperature at which a filler alloy melts at the time of brazing because the size of crystallized grains affects the buckling resistance of the fin only after the filler alloy is melted at a temperature of around 600° C.

Accordingly, an object of the present invention is to provide a fin material made of an aluminum alloy for heat exchangers with no fin buckling deformation and having excellent buckling resistance in a temperature range of 400° C. to 580° C., which is equal to or below a temperature at which a filler alloy melts at the time of brazing.

Solution to Problem

The inventors of the present invention conducted an intensive investigation to solve the above problem, and completed the present invention by finding out that a fin material having high strength and excellent buckling resistance at a temperature at which a filler alloy starts to melt at the time of brazing can be obtained by using an aluminum alloy material having a particular component, selecting homogenizing treatment condition, hot rolling condition, and annealing condition, and adjusting the particle diameter and the distribution of intermetallic compounds and the amount of solid solution of Mn.

That is, the present invention (1) provides a fin material made of an aluminum alloy for heat exchangers, containing 1.0 to 2.0 mass % of Mn, 0.7 to 1.4 mass % of Si, and 0.05 to 0.3 mass % of Fe, with the balance being Al and unavoidable impurities, wherein a number density of intermetallic compounds having a circle-equivalent diameter of 0.025 to 0.4 μm is $3.0\times10^6$ particles/mm$^2$ or more, and an amount of solid solution of Mn is 0.3 mass % or less.

The present invention provides a fin material made of an aluminum alloy for heat exchangers according to claim 1, further containing one or more kinds of 0.5 to 4.0 mass % of Zn, 0.01 to 0.4 mass % of Cu, 0.01 to 0.3 mass % of Mg, and 0.05 to 0.3 mass % of Ti.

Advantageous Effects of Invention

The present invention provides a fin material made of an aluminum alloy for heat exchangers with no fin buckling deformation of a fin material and having excellent buckling resistance in a temperature range of 400° C. to 580° C. before a filler alloy melts at the time of brazing.

DESCRIPTION OF EMBODIMENTS

A fin material made of an aluminum alloy for heat exchangers of the present invention contains 1.0 to 2.0 mass % of Mn, 0.7 to 1.4 mass % of Si, and 0.05 to 0.3 mass % of Fe, with the balance being Al and unavoidable impurities, wherein a number density of intermetallic compounds having a circle-equivalent diameter of 0.025 to 0.4 μm is $3.0\times10^6$ particles/mm$^2$ or more, and an amount of solid solution of Mn is 0.3 mass % or less.

The fin material made of an aluminum alloy for heat exchangers of the present invention contains Mn, Si, and Fe as essential elements, with the balance being Al and unavoidable impurities. The fin material made of an aluminum alloy for heat exchangers of the present invention may include unavoidable impurities of 0.05 mass % or less respectively, and 0.15 mass % or less in total.

The content of Mn in an aluminum alloy according to the fin material made of an aluminum alloy for heat exchangers of the present invention is 1.0 to 2.0 mass %, and preferably 1.2 to 1.8 mass %. Mn is an essential element for enhancing the strength in a temperature range of 400° C. to 580° C. before the filler alloy melts at the time of brazing. Mn generates Al—Mn—Si (—Fe) based intermetallic compounds together with Si, contributes to dispersion strengthening, and improves material strength at high temperature. If the content of Mn in the aluminum alloy is below the above range, the effects are not exerted sufficiently. If the content of Mn in the aluminum alloy exceeds the above range, coarse intermetallic compounds are generated at the time of casting, rolling property is degraded, and manufacturing of a sheet material becomes difficult.

The content of Si in the aluminum alloy according to the fin material made of an aluminum alloy for heat exchangers of the present invention is 0.70 to 1.4 mass %, and preferably 0.85 to 1.3 mass %. Si is an essential element for enhancing the strength in a temperature range of 400 to 580° C. before the filler alloy melts at the time of brazing. Si generates Al—Mn–Si (—Fe) based intermetallic compounds together with Al, contributes to dispersion strengthening, and improves material strength at high temperature. If the content of Si in the aluminum alloy is below the above range, the effects are not exerted sufficiently. If the content of Si in the aluminum alloy exceeds the above range, the amount of solid solution of Si increases and the melting point decreases, and may be susceptible to melting of a fin material due to excessive brazing erosion at the time of braze-heating.

The content of Fe in the aluminum alloy according to the fin material made of an aluminum alloy for heat exchangers of the present invention is 0.05 to 0.3 mass %, and preferably more than 0.1 mass % and 0.3 mass % or less. If the content of Fe in an aluminum alloy exceeds the above range, a large number of coarse crystallized products (intermetallic compounds) generated at the time of casting are generated, and as a result, precipitation of fine intermetallic compounds is decreased. Accordingly, a desired strength cannot be obtained in a temperature range of 400 to 580° C., and also, self-corrosion resistance of the fin material may be degraded because the crystallized products (intermetallic compounds) generated at the time of casting become a corrosion starting point. If the content of Fe in an aluminum alloy is below the above range, the amount of solid solution of Mn increases and the melting point decreases, and may be susceptible to melting of the fin material due to brazing erosion at the time of braze-heating. In addition, it causes increase in cost because high-purity aluminum metal needs to be used.

The aluminum alloy according to the fin material made of an aluminum alloy for heat exchangers of the present invention may further contain one or more kinds of 0.5 to 4.0 mass % of Zn, 0.01 to 0.4 mass % of Cu, 0.01 to 0.3 mass % of Mg, and 0.05 to 0.3 mass % of Ti.

The aluminum alloy according to the fin material made of an aluminum alloy for heat exchangers of the present invention may further contain 0.5 to 4.0 mass % of Zn. Zn provides a sacrificial anode effect by lowering the potential of the fin material. If the content of Zn in the aluminum alloy is below the above range, the effects will not be exerted sufficiently. If the content of Zn exceeds the above range, self-corrosion resistance of the fin material may be degraded.

The aluminum alloy according to the fin material made of an aluminum alloy for heat exchangers of the present invention may further contain 0.01 to 0.40 mass % of Cu. Cu has a function of enhancing the strength at high temperature of the fin material by solid-solution strengthening. If the content of Cu in the aluminum alloy is below the above range, the effects will not be exerted sufficiently. If the content of Cu exceeds the above range, the potential of the fin material becomes high, and a sacrificial anode effect may be degraded.

The aluminum alloy according to the fin material made of an aluminum alloy for heat exchangers of the present invention may further contain 0.01 to 0.30 mass % of Mg. Mg has a function of enhancing the strength at high temperature of the fin material by solid-solution strengthening. If the content of Mg is below the above range, the effects will not be exerted sufficiently. If the content of Mg exceeds the above range, brazing failure may occur due to reaction with a flux.

The aluminum alloy according to the fin material made of an aluminum alloy for heat exchangers of the present invention may further contain 0.05 to 0.30 mass % of Ti, and preferably 0.1 to 0.2 mass % of Ti. Ti enhances the strength by solid-solution strengthening. If the content of Ti in the aluminum alloy is below the above range, such effects may not be obtained. If the content of Ti exceeds the above range, it becomes susceptible to form huge intermetallic compounds, and lowers plastic workability.

In the aluminum alloy according to the fin material made of an aluminum alloy for heat exchangers of the present invention, the number density of intermetallic compounds having a circle-equivalent diameter of 0.025 to 0.4 μm is $3.0\times10^6$ particles/mm$^2$ or more, preferably $3.8\times10^6$ particles/mm$^2$ or more, and more preferably $4.0\times10^6$ particles/mm$^2$ or more. In the fin material made of an aluminum alloy for heat exchangers of the present invention, since intermetallic compounds having a circle-equivalent diameter of 0.025 to 0.4 μm exists in the aluminum alloy in the above number density, high-temperature strength at 500° C. becomes 15 MPa or more, preferably 17 MPa or more. Therefore, buckling deformation of the fin during braze-heating can be prevented. In the present invention, the circle-equivalent diameter is specifically a projected area circle-equivalent diameter (Heywood diameter). The high-temperature strength at 500° C. indicates a strength when braze-heating is performed at a temperature elevation rate of 10° C./min and reaching 500° C. This is on the premise that the recrystallization of the fin material is completed before reaching 500° C.

Although dispersion strengthening and solid-solution strengthening are considered to enhance high-temperature strength of a fin material made of an aluminum alloy, the inventors of the present invention found out as a result of an intensive investigation that high-temperature strength can be enhanced by making intermetallic compounds having large contribution to dispersion strengthening densely exist in a temperature range of 400° C. to 580° C. before a filler alloy melts at the time of brazing. Also the inventors of the present invention found out that although a part of intermetallic compounds (particularly, Al—Mn—Si (—Fe) based compounds) is solid-dissolved during braze-heating, the distribution of intermetallic compounds remaining during braze-heating is based on the distribution of intermetallic compounds before braze-heating. Thus, a material in which intermetallic compounds are densely dispersed before braze-heating has a dense distribution of intermetallic compound remaining during braze-heating, and enhances high-temperature strength. If the number density of intermetallic compounds having a circle-equivalent diameter of 0.025 to 0.4 μm is $3.0\times10^6$ particles/mm$^2$ or more, preferably $3.8\times10^6$ particles/mm$^2$ or more, and more preferably $4.0\times10^6$ particles/mm$^2$ or more, precipitates become large in a temperature range of 400° C. to 580° C. before a filler alloy melts at the time of brazing, the effect of the dispersion strengthening is exerted sufficiently, and high-temperature strength becomes sufficiently enhanced even in a temperature region of 400° C. to 580° C. before a filler alloy melts at the time of brazing. In the fin material made of an aluminum alloy for heat exchangers of the present invention, the higher the number density of intermetallic compounds having the circle-equivalent diameter described above is, the higher the density of intermetallic compounds remaining in a temperature range of 400° C. to 580° C. before a filler alloy melts at the time of brazing is, and results in enhancing high-temperature strength. Accordingly, although the upper limit of the density of intermetallic compounds described above is not particularly limited, it is normally $2.0\times10^7$ particles/mm$^2$ or less.

The amount of solid solution of Mn in an aluminum alloy according to the fin material made of an aluminum alloy for heat exchangers of the present invention is 0.3 mass % or less, and preferably 0.2 mass % or less. If the amount of solid solution of Mn exceeds 0.3 mass %, recrystallization is delayed due to precipitation of Al—Mn—Si (—Fe) based intermetallic compounds during braze-heating. If a load is applied to the fin material when a worked structure of the fin material is recovered and recrystallized during braze-heating, deformation may occur due to diffusion of vacancies through dislocation and the like. This deformation becomes remarkable as the temperature becomes high. Furthermore, the deformation occurs even when material strength is high in a state where recrystallization is not completed. Accordingly, it is preferable to complete the recrystallization of the fin material during braze-heating at an early stage. In the fin material made of an aluminum alloy for heat exchangers of the present invention, recrystallization completion temperature at the time of braze-heating is 400° C. or less, and preferably 380° C. or less. As described above, if the amount of solid solution of Mn exceeds 0.3 mass %, recrystallization temperature during braze-heating exceeds 400° C. As a result, deformation of the fin cannot be suppressed in a temperature range of 400° C. to 580° C.

The fin material made of an aluminum alloy for heat exchangers of the present invention is braze-heated at a temperature elevation rate of 10° C./min or more, and the tensile strength of the fin material made of an aluminum alloy when reaching 500° C. is 15 MPa or more, and preferably 17 MPa or more. As described above, although a part of intermetallic compounds (particularly, Al—Mn—Si (—Fe) based compounds) is solid-dissolved during braze-heating, the distribution of intermetallic compounds remaining during braze-heating is based on the distribution of intermetallic compounds before braze-heating. Thus, a material in which intermetallic compounds are densely dispersed before braze-heating has a dense distribution of intermetallic compound remaining during braze-heating, and contributes to enhancing high-temperature strength. If the temperature elevation rate at the time of braze-heating is below 10° C./min, solid-dissolution and growing of intermetallic compounds are progressed too much during a period before reaching 500° C. Thus, even though the density of intermetallic compounds before braze-heating is the density of the intermetallic compounds of the aluminum alloy of the fin material made of an aluminum alloy for heat exchangers of the present invention, such effect may not be obtained.

The fin material made of an aluminum alloy for heat exchanges of the present invention completes the processes of recovering and recrystallization prone to deformation in an early stage below or at 400° C. during brazing, and has high strength at a high temperature in a temperature region of 400° C. to 580° C. before a filler alloy melts, and therefore has excellent buckling resistance in a temperature range of 400° C. to 580° C. before a filler alloy melts at the time of brazing.

In the aluminum alloy according to the fin material made of an aluminum alloy for heat exchangers of the present invention, the distribution of intermetallic compounds before braze-heating and the amount of solid solution of Mn are determined mainly in the processes from casting to hot rolling and in the subsequent process of annealing. Accordingly, in order to improve material strength in a temperature range of 400° C. to 580° C. before a filler alloy melts at the time of brazing, it is necessary to control the conditions of these processes, and make the distribution to be the distribution of intermetallic compounds of the aluminum alloy according to the fin material made of an aluminum alloy for heat exchangers of the present invention.

In regard to a method of manufacturing a fin material made of an aluminum alloy for heat exchangers of the present invention, first, an ingot is produced by casting a molten aluminum alloy so as to correspond to the above described composition. Then, in order to provide excellent high temperature and buckling resistance, it is preferable to suppress the precipitation of coarse intermetallic compounds, and not to perform homogenization treatment with respect to the ingot obtained by casting from the point of view of increasing the number density.

Next, an ingot obtained by casting is hot rolled. At this time, in order to ultimately obtain an aluminum alloy having the number density of intermetallic compounds having a circle-equivalent diameter of 0.025 to 0.4 μm of $3.0\times10^6$ particles/mm$^2$ or more, preferably $3.8\times10^6$ particles/mm$^2$ or more, and more preferably $4.0\times10^6$ particles/mm$^2$ or more, and the amount of solid solution of Mn of 0.3 mass % or less, and more preferably 0.2 mass % or less, it is preferable to make the range of heating temperature before hot rolling to be 380 to 480° C., and more preferably 400 to 460° C. If the heating temperature before hot rolling exceeds the above range, the precipitated intermetallic compounds become coarse, sufficient dispersion strength by intermetallic compounds cannot be obtained during braze-heating, and high-temperature strength becomes degraded. If the heating temperature before hot rolling is below the above range, since hot strength of the material at the time of rolling is high, a high power hot-rolling mill becomes necessary, and also, rolling becomes difficult due to excessive ear cracking at the time of rolling. Then, although hot rolling is started at the heating temperature before hot rolling described above, it is preferable to make the temperature of a hot rolled sheet to be 360 to 480° C. in the hot rolling stage until the total rolling ratio reaches 50% after starting the hot rolling. Processing, recovering, and recrystallization in the rolled sheet occur consecutively during hot rolling and promotes precipitation of intermetallic compounds on a subgrain boundary formed in the process of recovering. If the temperature of the hot rolled sheet in the hot rolling stage exceeds the above range, intermetallic compounds grow and the number density becomes low, and a predetermined density of intermetallic compounds will not be obtained, resulting in lowering material strength at high temperature. If the temperature is below the above range, precipitation itself of intermetallic compounds becomes small, and a predetermined number density of intermetallic compounds and material strength at high temperature cannot be obtained. Moreover, the amount of solid solution of Mn becomes 0.3 mass % or more, the recrystallization temperature during braze-heating exceeds 400° C., and as a result, deformation of the fin in a temperature range of 400° C. to 580° C. cannot be suppressed.

Next, the hot rolled sheet obtained by hot rolling is cold rolled. In the cold rolling, intermediate annealing may be performed once or twice in total until reaching the final sheet thickness, or final annealing may be performed after the final cold rolling. The annealing temperature during that time is preferably 100 to 280° C. If the annealing temperature exceeds the above range, the precipitated intermetallic compounds become coarse, and the number density becomes small. Accordingly, in the temperature range of 400 to 580° C. before the filler alloy melts during brazing, sufficient dispersion strength by intermetallic compounds cannot be obtained, and the material strength degrades. If the annealing temperature is below the above range, the effect of annealing is not obtained, and is uneconomical.

The fin material made of an aluminum alloy for heat exchangers of the present invention is preferably used as a fin for heat exchangers. For example, the fin material made of an aluminum alloy for heat exchangers of the present invention is, after being formed into a fin shape by corrugation forming, assembled with heat exchanger members such as a flow passage forming part, a header plate, and the like, and is subjected to braze-heating, thereby obtaining a heat exchanger.

The above heat exchanger is assembled by arranging the fin material to an outer surface of the flow passage forming part in which both end parts are attached to the header plate. Next, the superimposed parts of both ends of the flow passage forming part, the fin material and the outer surface of the flow passage forming part, and both ends of the flow passage forming part and the header plate are joined simultaneously by a single braze-heating. The method of brazing may be brazing without flux, a flux brazing method such as NOCOLOK® brazing, and vacuum brazing.

EXAMPLES

Next, the present invention will be described in more details based on the examples of the present invention and comparative examples, but the invention is not intended to be limited thereto.

Aluminum alloys having chemical compositions shown in Table 1 were melted by an ordinary method, ingots were formed by semi-continuous casting, and both faces thereof were faced and finished. The thickness of each of the faced ingots was 400 mm. These ingots of aluminum alloys were not subjected to homogenizing treatment, and subjected to heating with the retention time of 6 hours at a temperature shown in Table 2 before hot rolling. Then, hot rolling was started at that temperature, and hot rolling was performed up to ultimately having a thickness of 3.0 mm under a condition shown in Table 2. Thereafter, cold rolling was performed, and, in the course thereof, subjected to intermediate annealing with the retention time of 3 hours at a temperature shown in Table 3. Then, cold-finish rolling was performed, and a fin material having a sheet thickness of 0.07 mm was obtained. The present invention is not limited to the sheet thickness of the final sheet of the present example. The thickness of the final sheet is generally around 0.03 to 0.10 mm.

TABLE 1

| | | Chemical compositions ( mass %) | | | | | | |
|---|---|---|---|---|---|---|---|---|
| | Alloy No. | Mn | Si | Fe | Zn | Cu | Mg | Ti |
| Example | 1 | 1.4. | 1.0 | 0.12 | 1.0 | — | — | — |
| | 2 | 1.2 | 1.4 | 0.15 | 4.0 | — | 0.20 | — |
| | 3 | 1.6 | 0.7 | 0.2 | 2.0 | — | — | — |
| | 4 | 2.0 | 1.0 | 0.15 | 0.5 | 0.20 | — | — |
| | 5 | 1.0 | 1.3 | 0.15 | 2.0 | — | 0.10 | — |
| | 6 | 1.2 | 0.9 | 0.2 | — | — | 0.30 | 0.05 |
| | 7 | 1.4 | 1.2 | 0.05 | 0.5 | — | 0.10 | — |
| | 8 | 1.6 | 1.3 | 0.12 | 4.0 | — | — | — |
| | 9 | 1.6 | 0.85 | 0.2 | 0.5 | 0.30 | — | — |
| | 10 | 1.8 | 1.2 | 0.2 | 1.0 | 0.10 | — | — |
| | 11 | 1.2 | 1.1 | 0.15 | 3.0 | — | 0.10 | 0.30 |
| | 12 | 1.4 | 1.2 | 0.3 | 0.5 | 0.01 | — | — |
| | 13 | 1.6 | 1.1 | 0.2 | 2.0 | 0.40 | 0.05 | — |
| Comparative | 14 | 2.4 | 1.2 | 0.2 | — | — | — | — |
| Example | 15 | 0.7 | 0.9 | 0.2 | 1.0 | — | — | — |
| | 16 | 1.4 | 1.6 | 0.15 | 1.0 | — | — | — |
| | 17 | 1.2 | 0.6 | 0.2 | 2.0 | — | — | — |
| | 18 | 1.6 | 1.2 | 0.5 | 1.0 | — | — | — |
| | 19 | 1.4 | 1.3 | 0.02 | 2.0 | — | — | — |
| | 20 | 1.4 | 0.9 | 0.2 | 0.5 | — | — | 0.4 |
| | 21 | 1.6 | 1.1 | 0.12 | 4.5 | — | — | — |
| | 22 | 1.2 | 1.3 | 0.2 | 2.0 | 0.6 | — | — |
| | 23 | 1.4 | 1.0 | 0.3 | 2.0 | — | 0.4 | — |

TABLE 2

| | | | | Hot rolling condition | | |
|---|---|---|---|---|---|---|
| | Example No. | Alloy No. | Homogenizing treatment | Heating temperature before hot rolling (° C.) | Temperature of hot rolled sheet at the time of reaching sheet thickness of 28 mm (° C.) | Intermediate annealing heating temperature (° C.) |
| Example | 1 | 1 | none | 440 | 400 | 180 |
| | 2 | 2 | none | 440 | 400 | 180 |
| | 3 | 3 | none | 400 | 380 | 180 |
| | 4 | 4 | none | 420 | 380 | 180 |
| | 5 | 5 | none | 420 | 380 | 180 |
| | 6 | 6 | none | 460 | 400 | 180 |
| | 7 | 7 | none | 440 | 380 | 140 |
| | 8 | 8 | none | 380 | 360 | 180 |

TABLE 2-continued

| | Example No. | Alloy No. | Homogenizing treatment | Hot rolling condition: Heating temperature before hot rolling (° C.) | Hot rolling condition: Temperature of hot rolled sheet at the time of reaching sheet thickness of 28 mm (° C.) | Hot rolling condition: Intermediate annealing heating temperature (° C.) |
|---|---|---|---|---|---|---|
| | 9 | 9 | none | 480 | 420 | 160 |
| | 10 | 10 | none | 480 | 440 | 200 |
| | 11 | 11 | none | 460 | 420 | 180 |
| | 12 | 12 | none | 460 | 420 | 180 |
| | 13 | 13 | none | 400 | 360 | 180 |
| | 14 | 1 | none | 480 | 440 | 180 |
| | 15 | 1 | none | 420 | 400 | 180 |
| | 16 | 1 | none | 380 | 360 | 180 |
| | 17 | 6 | none | 440 | 400 | 180 |
| | 18 | 7 | none | 380 | 360 | 180 |
| | 19 | 8 | none | 440 | 400 | 160 |
| | 20 | 9 | none | 420 | 380 | 180 |
| | 21 | 10 | none | 440 | 400 | 180 |
| | 22 | 11 | none | 460 | 420 | 160 |
| | 23 | 13 | none | 460 | 420 | 160 |
| Comparative Example | 24 | 1 | 500° C. × 10 hr | 460 | 420 | 220 |
| | 25 | 11 | none | 500 | 440 | 220 |
| | 26 | 5 | none | 400 | 320 | 140 |
| | 27 | 6 | none | 460 | 400 | 320 |
| | 28 | 1 | none | 360 | Cancelled during hot rolling | |
| | 29 | 14 | none | 460 | Cancelled during hot rolling | |
| | 30 | 15 | none | 400 | 360 | 160 |
| | 31 | 16 | none | 440 | 400 | 180 |
| | 32 | 17 | none | 420 | 400 | 140 |
| | 33 | 18 | none | 400 | 380 | 220 |
| | 34 | 19 | none | 440 | 390 | 140 |
| | 35 | 20 | none | 460 | 410 | Cancelled during cold rolling |
| | 36 | 21 | none | 400 | 370 | 180 |
| | 37 | 22 | none | 440 | 400 | 220 |
| | 38 | 23 | none | 440 | 400 | 180 |

The density of intermetallic compounds before braze-heating and the amount of solid solution of Mn were measured with respect to the fin material obtained as described above. As the characteristics during braze-heating, by a tensile test of the material heated up to 400° C., whether recrystallization of the fin material at the time of reaching 400° C. during braze-heating was completed or not was confirmed, and the amount of drooping of the fin material up to 550° C. was measured by a sagging test. In addition, a brazability test and a corrosion resistance test were performed. The results of these are shown in Table 3.

1. The Density of Intermetallic Compounds before Braze-Heating

A field emission-scanning electron microscopy (FE-SEM) was used for the measurement. Compounds on a surface of a fin material sample were observed, and the number density of intermetallic compounds having a predetermined circle-equivalent diameter was measured by image analysis. Specifically, twenty viewing fields were observed with a magnification of 20,000, and the number density of intermetallic compounds having a circle-equivalent diameter of 0.025 μm to 0.4 μm was calculated after a binarizing process.

2. Tensile Strength of the Fin at 500° C.

A fin material sample before braze-heating was formed in a JIS No. 13 B tensile test piece, and the tensile strength was measured at 500° C. by a tensile testing machine. A temperature elevation rate of the fin material up to 500° C. was 100° C./min. Then, after the fin material reached 500° C., a tensile test was performed at a tensile speed of 2 mm/min, while the temperature was retained. The tensile strength was read from the obtained stress-strain curve. If the tensile strength was 17 MPa or more, the result was indicated as "⊙", if the tensile strength was 15 MPa or more to below 17 MPa, the result was indicated as "○", and if the tensile strength was below 15 MPa, the result was indicated as "x".

3. The Amount of Solid Solution of Mn before Braze-Heating

A fin material before braze-heating was dissolved in a phenol solution, the undissolved intermetallic compounds were removed by filtration, subjected to emission analysis, and the amount of solid solution of Mn was measured.

4. Tensile Test at a Room Temperature after Heating Up to 400° C.

The fin material was heated up to 400° C. at a temperature evaluation rate of 100° C./min, and subjected to a tensile test in accordance with JIS Z2241, under conditions of a tensile speed of 10 mm/min and a gauge length of 50 mm at a room temperature. 0.2% proof stress was read from the obtained stress-strain curve. The recrystallization was determined to be completed if the value was 80 MPa or less, and indicated as success (○). The recrystallization was determined to be incomplete if the value exceeded 80 MPa, and was indicated as failure (x).

5. The Amount of Drooping of the Fin at 550° C.

Each fin material was cut into a size having a width of 10 mm and a length of 55 mm. A portion at a length of 40 mm was projected in a non-supported state, and the remaining 15-mm portion was heated up to 580° C. in a state horizontally held by a jig. The temperature elevation rate of the fin material up to 550° C. was 100° C./min. After heating, the amount of drooping of the edge of the projected portion of the fin material was measured. If the amount was 15 mm or less, the result was indicated as "⊙", if the amount exceeded 15 mm and was 18 mm or less, the result was indicated as "○", and if the amount exceeded 18 mm, the result was indicated as "x".

6. Brazability Test

Each fin material was subjected to corrugation forming, and a miniature core was manufactured by assembling with a tube material having a thickness of 0.25 mm using JIS A3003 alloys as a core material and JIS A4045 alloys as a skin material (filler alloy, cladding rate of 10%). A fluoride-based flux having a concentration of 3% was applied, heated for 3 minutes at 600° C. in a nitrogen gas atmosphere, and brazing was performed. Next, each braze-joined fin material was physically removed from the tube material by a cutter blade, and a trace of a fin joining part remaining on the surface of the tube material was observed. Then, the number of non-joining portions (portions in which no trace of joining parts remained after brazing) was counted, and a joining ratio based on the following formula was obtained. A joining ratio of 90% or more was indicated as "○", and a joining ratio of below 90% was indicated as "x".

Joining ratio (%)=(1−the number of non-joining portions/the number of entire joining portions)×100

The number of entire joining portions: The number of entire brazing portions

The number of non-joining portions: The number of portions in which no trace of joining parts remained after brazing Furthermore, every fifty portions of the cross section of the joining parts of the fin material of the braze-joined miniature core and the tube were observed, and the number of portions in which half or more of the thickness of the fin material was melted was counted, and a fin melting ratio based on the following formula was obtained.

Fin melting ratio (%)=(the number of joining portions in which half or more of the thickness of the fin material was melted/the number of observed joining portions)×100

A fin melting ratio of 10% or less was indicated as "⊙", a fin melting ratio exceeding 10% and 20% or less was indicated as "○", and a fin melting ratio exceeding 20% was indicated as "x".

7. Corrosion Resistance Test

A miniature core of a heat exchanger manufactured similarly to the case of the brazing test was subjected to a CASS test for 1 month according to JIS H8681, a corrosion state of the fin material and the tube material was investigated, and the corrosion resistance was evaluated. Quality of the corrosion resistance was evaluated as follows. If the tube material had no through holes, it was evaluated as ○: good. If the tube material had through holes and the self-corrosion of the fin material was large, it was evaluated as x: poor.

TABLE 3

| | Example No. | Alloy No. | Density of intermetallic compounds having a circle-equivalent diameter of 0.025 to 0.4 μm before braze-heating: D (particles/mm$^2$) | Amount of solid solution of Mn before braze-heating (mass %) | Tensile strength at 500° C. (MPa) | | Recrystallization completion temperature | Sagging test Amount of drooping up to 550° C. (mm) | | Miniature core brazing evaluation: Brazability (%) | | Fin melting ratio (%) | | Corrosion resistance |
|---|---|---|---|---|---|---|---|---|---|---|---|---|---|---|
| Example | 1 | 1 | $6.0 \times 10^6$ | 0.09 | 19.4 | ⊙ | ○ | 9 | ⊙ | 100 | ○ | 4 | ⊙ | ○ |
| | 2 | 2 | $5.0 \times 10^6$ | 0.15 | 18.2 | ⊙ | ○ | 10 | ⊙ | 98 | ○ | 10 | ⊙ | ○ |
| | 3 | 3 | $3.9 \times 10^6$ | 0.22 | 16.9 | ○ | ○ | 16 | ○ | 100 | ○ | 6 | ⊙ | ○ |
| | 4 | 4 | $6.5 \times 10^6$ | 0.19 | 20.1 | ⊙ | ○ | 9 | ⊙ | 100 | ○ | 2 | ⊙ | ○ |
| | 5 | 5 | $3.9 \times 10^6$ | 0.16 | 16.5 | ○ | ○ | 17 | ○ | 98 | ○ | 8 | ⊙ | ○ |
| | 6 | 6 | $4.5 \times 10^6$ | 0.17 | 17.8 | ⊙ | ○ | 15 | ⊙ | 95 | ○ | 2 | ⊙ | ○ |
| | 7 | 7 | $5.9 \times 10^6$ | 0.11 | 19.3 | ⊙ | ○ | 10 | ⊙ | 97 | ○ | 14 | ○ | ○ |
| | 8 | 8 | $3.9 \times 10^6$ | 0.25 | 16.7 | ○ | ○ | 17 | ○ | 100 | ○ | 6 | ⊙ | ○ |
| | 9 | 9 | $3.4 \times 10^6$ | 0.28 | 15.9 | ○ | ○ | 18 | ○ | 100 | ○ | 2 | ⊙ | ○ |
| | 10 | 10 | $3.7 \times 10^6$ | 0.28 | 16.6 | ○ | ○ | 16 | ○ | 100 | ○ | 4 | ⊙ | ○ |
| | 11 | 11 | $4.6 \times 10^6$ | 0.14 | 18.0 | ⊙ | ○ | 13 | ⊙ | 100 | ○ | 4 | ⊙ | ○ |
| | 12 | 12 | $5.8 \times 10^6$ | 0.11 | 19.1 | ⊙ | ○ | 11 | ⊙ | 100 | ○ | 4 | ⊙ | ○ |
| | 13 | 13 | $5.4 \times 10^6$ | 0.18 | 18.8 | ⊙ | ○ | 11 | ⊙ | 100 | ○ | 4 | ⊙ | ○ |
| | 14 | 1 | $3.2 \times 10^6$ | 0.28 | 15.4 | ○ | ○ | 18 | ○ | 100 | ○ | 4 | ⊙ | ○ |
| | 15 | 1 | $5.7 \times 10^6$ | 0.12 | 19.0 | ⊙ | ○ | 10 | ⊙ | 100 | ○ | 4 | ⊙ | ○ |
| | 16 | 1 | $3.5 \times 10^6$ | 0.26 | 16.0 | ○ | ○ | 17 | ○ | 100 | ○ | 4 | ⊙ | ○ |
| | 17 | 6 | $4.9 \times 10^6$ | 0.17 | 18.1 | ⊙ | ○ | 14 | ⊙ | 96 | ○ | 2 | ⊙ | ○ |
| | 18 | 7 | $3.5 \times 10^6$ | 0.23 | 16.1 | ○ | ○ | 17 | ○ | 98 | ○ | 14 | ○ | ○ |
| | 19 | 8 | $6.2 \times 10^6$ | 0.09 | 19.7 | ⊙ | ○ | 9 | ⊙ | 100 | ○ | 6 | ⊙ | ○ |
| | 20 | 9 | $5.8 \times 10^6$ | 0.13 | 19.2 | ⊙ | ○ | 10 | ⊙ | 100 | ○ | 2 | ⊙ | ○ |
| | 21 | 10 | $6.9 \times 10^6$ | 0.08 | 20.6 | ⊙ | ○ | 8 | ⊙ | 100 | ○ | 4 | ⊙ | ○ |
| | 22 | 11 | $4.2 \times 10^6$ | 0.19 | 17.5 | ⊙ | ○ | 14 | ⊙ | 100 | ○ | 4 | ⊙ | ○ |
| | 23 | 13 | $6.0 \times 10^6$ | 0.10 | 19.5 | ⊙ | ○ | 10 | ⊙ | 99 | ○ | 2 | ⊙ | ○ |
| | 24 | 1 | $1.2 \times 10^6$ | 0.28 | 7.6 | X | ○ | 25 | X | 100 | ○ | 4 | ⊙ | ○ |
| | 25 | 11 | $1.6 \times 10^6$ | 0.24 | 10.8 | X | ○ | 24 | X | 100 | ○ | 4 | ⊙ | ○ |
| Comparative Example | 26 | 5 | $1.9 \times 10^6$ | 0.26 | 12.1 | X | ○ | 24 | X | 97 | ○ | 2 | ⊙ | ○ |
| | 27 | 6 | $2.6 \times 10^6$ | 0.25 | 14.0 | X | ○ | 22 | X | 95 | ○ | 2 | ⊙ | ○ |
| | 28 | 1 | No measurement because hot rolling was not possible | | | | | | | | | | | |
| | 29 | 14 | No measurement because hot rolling was not possible | | | | | | | | | | | |
| | 30 | 15 | $2.2 \times 10^6$ | 0.09 | 13.1 | X | ○ | 23 | X | 100 | ○ | 4 | ⊙ | ○ |
| | 31 | 16 | $4.1 \times 10^6$ | 0.14 | 18.2 | ⊙ | ○ | 16 | ○ | 94 | ○ | 32 | X | ○ |
| | 32 | 17 | $2.8 \times 10^6$ | 0.32 | 14.2 | X | X | 34 | X | 100 | ○ | 2 | ⊙ | ○ |
| | 33 | 18 | $2.7 \times 10^6$ | 0.26 | 14.2 | X | ○ | 23 | X | 100 | ○ | 4 | ⊙ | X |
| | 34 | 19 | $3.2 \times 10^6$ | 0.37 | 15.5 | ○ | X | 28 | X | 96 | ○ | 26 | X | ○ |

TABLE 3-continued

| Example No. | Alloy No. | Density of intermetallic compounds having a circle-equivalent diameter of 0.025 to 0.4 μm before braze-heating: D (particles/mm$^2$) | Amount of solid solution of Mn before braze-heating (mass %) | Tensile strength at 500° C. (MPa) | | Recrystallization completion temperature | Sagging test Amount of drooping up to 550° C. (mm) | | Miniature core brazing evaluation Brazability (%) | | Fin melting ratio (%) | | Corrosion resistance |
|---|---|---|---|---|---|---|---|---|---|---|---|---|---|
| 35 | 20 | No measurement due to occurrence of cracking during cold rolling | | | | | | | | | | | |
| 36 | 21 | 4.9 × 10$^6$ | 0.14 | 20.7 | ⊙ | ○ | 14 | ⊙ | 100 | ○ | 12 | ○ | X |
| 37 | 22 | 4.0 × 10$^6$ | 0.14 | 18.2 | ⊙ | ○ | 15 | ⊙ | 100 | ○ | 24 | X | X |
| 38 | 23 | 4.5 × 10$^6$ | 0.12 | 19.9 | ⊙ | ○ | 15 | ⊙ | 82 | X | 16 | ○ | ○ |

Examples 1 to 23 satisfied the conditions stipulated in the present invention, and the tensile strength of the fin at 500° C. and the amount of drooping of the fin at 550° C. were successful. Brazing property and corrosion resistance were also successful.

In Comparative Examples 24 to 27, the homogenizing treatment condition, the hot rolling condition, or the annealing condition were not adequate, and the precipitated intermetallic compounds were coarse, or precipitation was insufficient, and the number density of intermetallic compounds having a circle-equivalent diameter of 0.025 to 0.4 μm was below 3.0 particles/μm$^2$. Accordingly, the tensile strength of the fin at 500° C. and the amount of drooping of the fin at 550° C. resulted in failure.

In Comparative Example 28, the heating temperature before hot rolling was low at 360° C., the hot strength of the material at the time of rolling was high, the cracking occurred during rolling, and resulted in not being able to be manufactured.

In Comparative Example 29, since the components of Mn in the fin material were excessive, the cracking occurred during rolling, and resulted in not being able to be manufactured.

In Comparative Example 30, since the components of Mn in the fin material were insufficient, the number density of intermetallic compounds having a circle-equivalent diameter of 0.025 to 0.4 μm was below 3.0 particles/μm$^2$. Accordingly, the tensile strength of the fin and at 500° C. and the amount of drooping of the fin at 550° C. resulted in failure.

In Comparative Example 31, since the components of Si in the fin material were excessive, the melting of the fin was remarkable in the brazing test, and resulted in failure.

In Comparative Example 32, since the components of Mn in the fin material were insufficient, the number density of intermetallic compounds having a circle-equivalent diameter of 0.025 to 0.4 μm was below 5.0 particles/μm$^2$, and the solid solution of Mn was 0.3 mass % or more. Accordingly, the tensile strength of the fin at 500° C. and the amount of drooping of the fin at 550° C. resulted in failure.

In Comparative Example 33, since the components of Fe in the fin material were excessive, the number density of intermetallic compounds having a circle-equivalent diameter of 0.025 to 0.4 μm was below 3.0 particles/μm$^2$, and the tensile strength of the fin at 500° C. and the amount of drooping of the fin at 550° C. resulted in failure. In the corrosion resistance evaluation, corrosion of the fin material was remarkable, and resulted in failure.

In Comparative Example 34, since the components of Fe in the fin material were insufficient, the amount of solid solution of Mn was 0.3 mass % or more. Accordingly, the amount of drooping of the fin at 550° C. resulted in failure. Furthermore, as a result of increase in the amount of solid solution of Mn and the like and decrease in the solidus temperature of the fin material, melting of the fin in the brazability test was remarkable, and resulted in failure.

In Comparative Example 35, since the components of Ti in the fin material were excessive, cracks occurred at the time of rolling, and the fin material was not able to be manufactured.

In Comparative Example 36, since the components of Zn in the fin material were excessive, corrosion of the fin material was remarkable in the corrosion resistance test, and resulted in failure.

In Comparative Example 37, since the components of Cu in the fin material were excessive, the sacrificial anode effect of the fin material was insufficient in the corrosion resistance test, and resulted in failure.

In Comparative Example 38, since the components of Mg in the fin material were excessive, the joining ratio was low in the brazability test, and resulted in failure.

INDUSTRIAL APPLICABILITY

The fin material made of an aluminum alloy for heat exchanges of the present invention completes the processes of recovering and recrystallization prone to deformation in an early stage below or at 400° C. during brazing, and has high strength at a high temperature in a temperature region of 400° C. to 580° C. before a filler alloy melts, and therefore has excellent buckling resistance in a temperature range of 400° C. to 580° C. before a filler alloy melts at the time of brazing.

The invention claimed is:

1. A method of manufacturing a fin material made of an aluminum alloy for heat exchangers, the method comprising:

a step of casting to obtain an ingot containing 1.0 to 2.0 mass % of Mn, 0.7 to 1.4 mass % of Si, and 0.05 to 0.3 mass % of Fe, with the balance being Al and unavoidable impurities;

after the step of casting, a step of hot rolling the ingot without being subjected to homogenizing treatment to obtain a hot-rolled material, with a range of heating temperature before the hot rolling being set to 380 to 480° C., and a range of temperature until the total rolling ratio reaches 50% after starting the hot rolling being set to 360 to 480° C.; and after the step of hot rolling, a step of cold rolling the hot-rolled material to obtain a final fin material made of the aluminum alloy for heat exchangers, wherein the step of cold rolling includes intermediate annealing, the intermediate annealing being performed at a temperature range of 100 to 280° C., and does not include final annealing, the final fin material made of the aluminum alloy for heat exchangers contains 1.0 to 2.0 mass % of Mn, 0.7 to 1.4 mass % of Si, and 0.05 to 0.3 mass % of Fe, with the balance being Al and unavoidable impurities, in the fin material made of an aluminum alloy for heat exchangers, a number density of intermetallic compounds having a circle-equivalent diameter of 0.025 to 0.4 μm is $3.0\times10^6$ particles/mm$^2$ or more, and an amount of solid solution of Mn is 0.3 mass % or less.

2. The method of manufacturing a fin material made of an aluminum alloy for heat exchangers according to claim 1, wherein the fin material made of an aluminum alloy for heat exchangers further contains one or more kinds of 0.5 to 4.0 mass % of Zn, 0.01 to 0.4 mass % of Cu, 0.01 to 0.3 mass % of Mg, and 0.05 to 0.3 mass % of Ti.

3. The method of manufacturing a fin material made of an aluminum alloy for heat exchangers according to claim 1, wherein, in the fin material made of an aluminum alloy for heat exchangers, the number density of intermetallic compounds having a circle-equivalent diameter of 0.025 to 0.4 μm is $4.0\times10^6$ particles/mm$^2$ or more.

4. The method of manufacturing a fin material made of an aluminum alloy for heat exchangers according to claim 2, wherein, in the fin material made of an aluminum alloy for heat exchangers, the number density of intermetallic compounds having a circle-equivalent diameter of 0.025 to 0.4 μm is $4.0\times10^6$ particles/mm$^2$ or more.

* * * * *